US006563063B1

(12) United States Patent
Moore

(10) Patent No.: US 6,563,063 B1
(45) Date of Patent: May 13, 2003

(54) SLIDE BAR INTERLOCKING DEVICE

(75) Inventor: Marshall R. Moore, Tampa, FL (US)

(73) Assignee: Tampa Armature Works, Inc., Tampa, FL (US)

( * ) Notice: Subject to any disclaimer, the term of this patent is extended or adjusted under 35 U.S.C. 154(b) by 0 days.

(21) Appl. No.: 09/683,155

(22) Filed: Nov. 27, 2001

(51) Int. Cl.[7] ..... H01H 9/26

(52) U.S. Cl. ..... 200/50.33; 200/5 B; 200/5 EA; 200/43.16; 335/160

(58) Field of Search ..... 200/50.32, 50.33, 200/50.35, 50.37, 5 B, 5 EA, 5 EB, 43.16, 43.19; 335/157, 160

(56) References Cited

U.S. PATENT DOCUMENTS 4,924,041 A * 5/1990 Yee ..... 200/50 C
5,357,070 A * 10/1994 Parsons, Jr. ..... 200/331
5,558,209 A * 9/1996 Mohsen ..... 200/43.22
5,726,401 A * 3/1998 Green et al. ..... 200/50.33
5,874,698 A * 2/1999 Collis ..... 200/50.33
6,096,986 A * 8/2000 Flegel ..... 200/50.33
6,184,482 B1 * 2/2001 Priem ..... 200/43.16
6,396,008 B1 * 5/2002 Maloney et al. ..... 200/43.14

* cited by examiner

*Primary Examiner*—Anh Mai
*Assistant Examiner*—K. Lee
(74) *Attorney, Agent, or Firm*—Anton J. Hopen; Smith & Hopen, P.A.

(57) ABSTRACT

An interlocking device for preventing the simultaneous throwing of a pair of switches. An elongate locking bar is provided with two laterally spaced apart switch actuator-receiving recesses formed therein. The elongate locking bar has a first position where a first switch actuator receiving recess is in alignment with a first switch actuator so that said first switch actuator can be thrown. A second switch actuator recess is misaligned with a second switch actuator when said first switch actuator recess is in alignment with the first switch actuator. The elongate locking bar has a second position where the second switch actuator receiving recess is in alignment with the second switch actuator so that the second switch actuator can be thrown. The first switch actuator recess is misaligned with the first switch actuator when the second switch actuator recess is in alignment with the second switch actuator.

6 Claims, 3 Drawing Sheets

SLIDE BAR INTERLOCKING DEVICE

BACKGROUND OF INVENTION

1. Field of the Invention

This invention relates, generally, to locking devices and more particularly to an interlocking means for preventing the simultaneous throwing of at least two switch actuators.

2. Description of the Prior Art

Power distribution centers often require cooperation between switch actuators.

Typically, the actuators operate to toggle power between alternate sources and are situated adjacently for convenience. Thus, when one switch is thrown to an "on" position the complementary switch is in an "off" position and vice versa. However, the convenience of having switches in close proximity leads to the vulnerability of the switches being accidentally thrown simultaneously. Thus, a variety of interlocking devices have been developed to prevent the simultaneous throwing of switches to an "on" position.

Continuing efforts are being made to improve interlocking devices. By way of example, note U.S. Pat. No. 5,902,974 to Fogle et al. that describes a slide bar interlock designed specifically for use with adjacently positioned circuit breakers having dissimilar actuating means. Similarly, U.S. Pat. No. 4,286,242 to Mrenna et al. describes plungers that engage the internal operating mechanisms of circuit breakers. Notwithstanding the existence of such prior art interlocking devices, there is a need for an improved and more efficient switch actuator interlock.

In summary, the needed improvements include an interlocking device that is easy to operate which is also durable and relatively failsafe.

However, in view of the prior art considered as a whole at the time the present invention was made, it was not obvious to those of ordinary skill in the pertinent art how the identified needs could be fulfilled.

SUMMARY OF INVENTION

The long-standing but heretofore unfulfilled need for an interlocking device for adjacent circuit breakers that is easy to operate, relatively failsafe, which prevents simultaneous throwing of at least two switch actuators, is now provided in the form of a new, useful and non-obvious device.

The interlocking device includes a pair of switch actuators mounted on a support surface in lateral relation to one another. Each switch actuator of the pair of switch actuators has a down position and an up position. An elongate locking bar is provided with two laterally spaced apart switch actuator-receiving recesses formed therein. The elongate locking bar is slideably mounted relative to the support surface for lateral displacement in closely spaced relation to said pair of switch actuators. The elongate locking bar has a first position where a first switch actuator receiving recess is in alignment with a first switch actuator so that said first switch actuator can be thrown. A second switch actuator recess is misaligned with a second switch actuator when said first switch actuator recess is in alignment with the first switch actuator. The elongate locking bar has a second position where the second switch actuator receiving recess is in alignment with the second switch actuator so that the second switch actuator can be thrown. The first switch actuator recess is misaligned with the first switch actuator when the second switch actuator recess is in alignment with the second switch actuator. The elongate locking bar prevents simultaneous throwing of the pair of switches.

An important object of the present invention is to provide an improved interlocking device, for use with circuit breakers and the like that prevents the simultaneous throwing of at least two switch actuators.

Another object is to provide an interlocking device that can be operated without undue effort so that the locking device provides a relatively failsafe device that protects associated equipment and persons from potential harm.

Another object is to provide a locking device suitable for different equipment without modification and which is durable and not susceptible to breakage.

These and other important objects, advantages, and features of the invention will become clear as this description proceeds.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
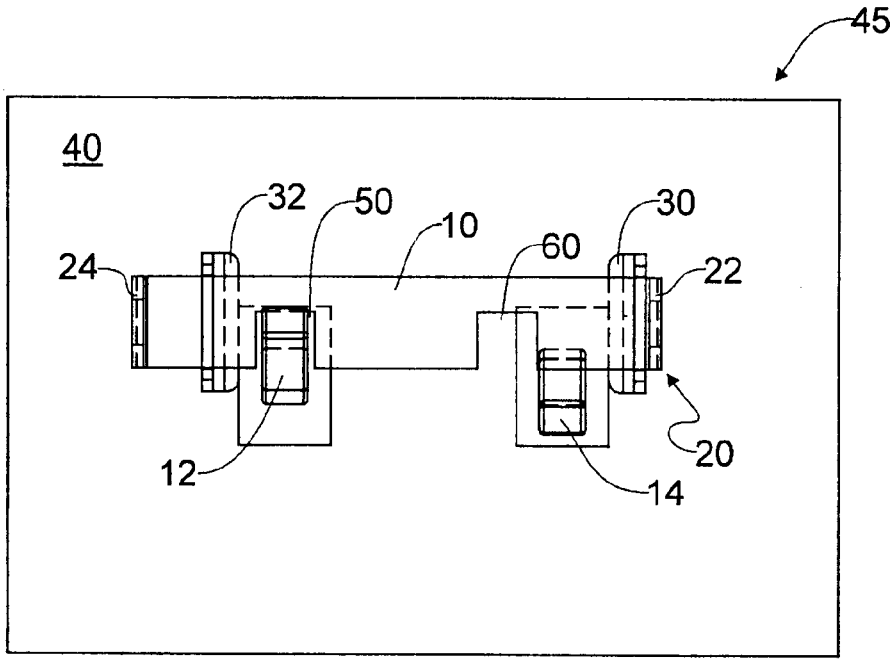
FIG. 1 is a front view of the interlocking device in a first position.
Figure 2:
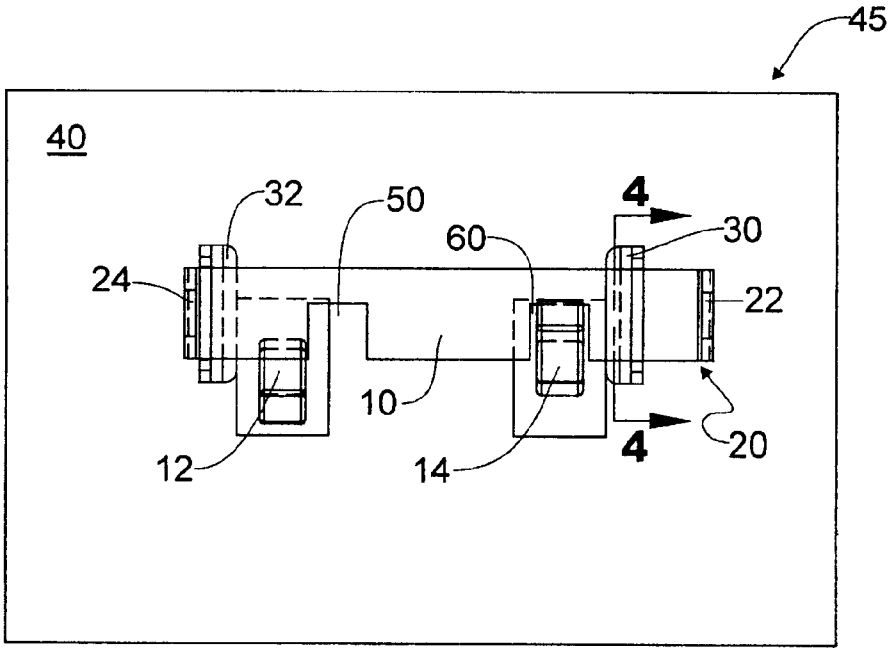
FIG. 2 is a front view of the interlocking device in a second position.

Referring now to FIGS. 1 and 2, it will there be seen that the reference numeral 20 denotes an illustrative embodiment of the novel interlocking device as a whole. A load center is contained within an enclosure 45. The load center 45 comprises at least two circuit breakers which are mounted to a support surface 40 of the enclosure 45 and which are connected to actuators 12 and 14. Support surface 40 is shown with first and second actuators 12, 14 projecting therefrom so as to provide manual operation of the operating mechanism associated with each respective circuit breaker. Locking bar 16 is adjacently positioned to actuators 12, 14 and spans between them. Actuator 12, as shown in FIG. 1, is in an "on" or up position so that the first circuit breaker is in a closed operating position. Each switch actuator 12, 14 has a down position and an up position correlating to open and closed operating positions, respectively. The first recess 50 of bar 10 is orientated to an aligned position with first actuator 12 so that it can be thrown i.e. , moved to an up position as shown. Concurrently, a second switch actuator 14 is misaligned with second recess 60 thereby preventing second switch actuator 14 from being simultaneously thrown with first actuator 12. As shown in FIG. 1, the lower edge of locking bar 10 prevents second actuator 14 from being moved to the up position. As can be appreciated, this maintains the second actuator in an open operating position. As can be further appreciated, this allows for the first actuator 12 to be placed in the closed position without the possibility of the second actuator 1 4 also being in the closed operating position. Locking bar 10 is shown with two recesses for receiving two respective actuators, however, locking bar 10 can be modified to incorporate a greater or less number of recesses for accommodating any number of actuators and associated circuit breakers.

As shown in FIG. 2, locking bar 10 of the interlocking device is disposed in a second position. Consequently, second recess 60 is now aligned with second actuator switch 14 thereby allowing second actuator 14 to be thrown. First actuator 12 is blocked by locking bar 10 from being thrown, as first recess 50 is misaligned with first actuator 12. Preceding moving locking bar 10 from the first to second position, first actuator 12 must be placed in a down position to avoid actuator 12 acting as a detent means for locking bar 10 and thereby preventing bar 10 from being slid to the second position.

Figure 3:
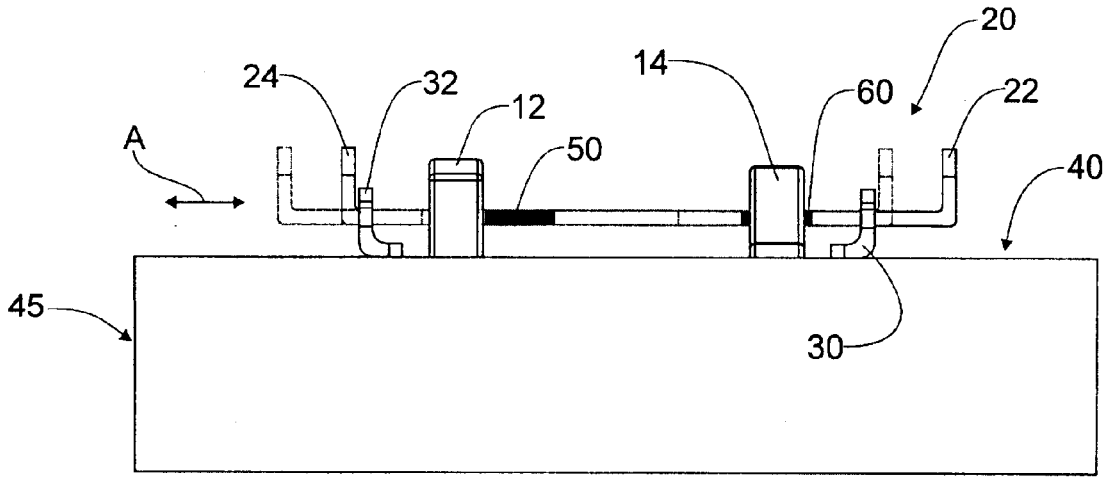
FIG. 3 is bottom view of the interlocking device in a second position.

Referring now to FIG. 3, the lateral sliding action of bar 10 is shown looking from the bottom of enclosure 45. Recesses 50 and 60 are shown with second actuator 14 in an up position and first actuator 12 in a down position. Guide members 30 are laterally spaced apart on support surface 40 and are shown collectively receiving bar 10 so that as bar 10 is slid between the first and second positions indicated by arrow A, bar 10 is guided by guide members 30.

Figure 4:
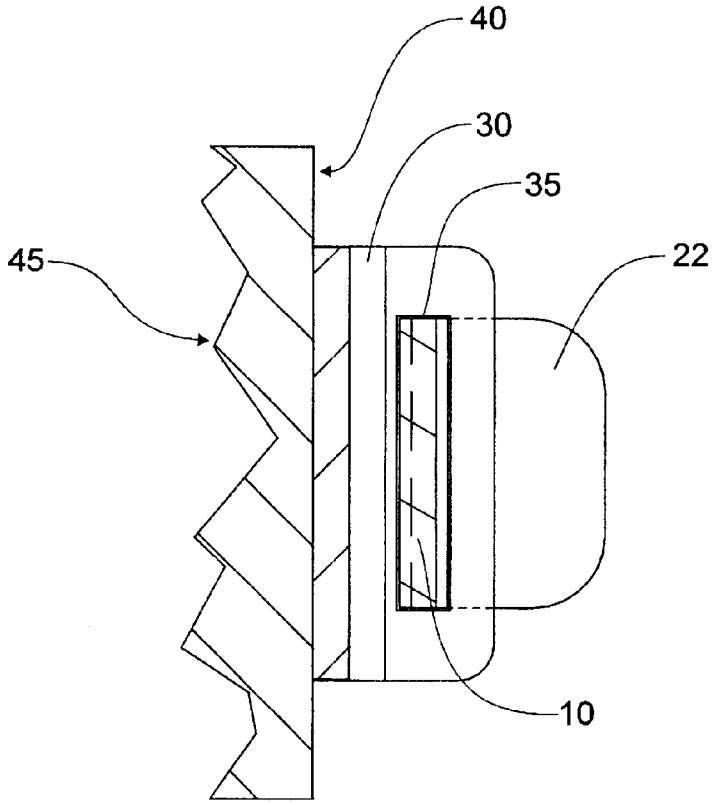
FIG. 4 is a sectional view taken along line 4—4 of FIG. 2.

As shown in FIG. 4, a vertically aligned slot 35 is formed within each guide member 30 for receiving bar 10 therein. As locking bar 10 is moved between first and second positions, a bend 22, 24 formed in opposite ends of the locking bar 10 prevents bar 10 from being removed completely from guide members 30. The second bend 22 is shown in abutting engagement with a projecting flange of guide member 30 as bar 10 is in the second position to allow actuator 14 to be thrown.

Figure 5:
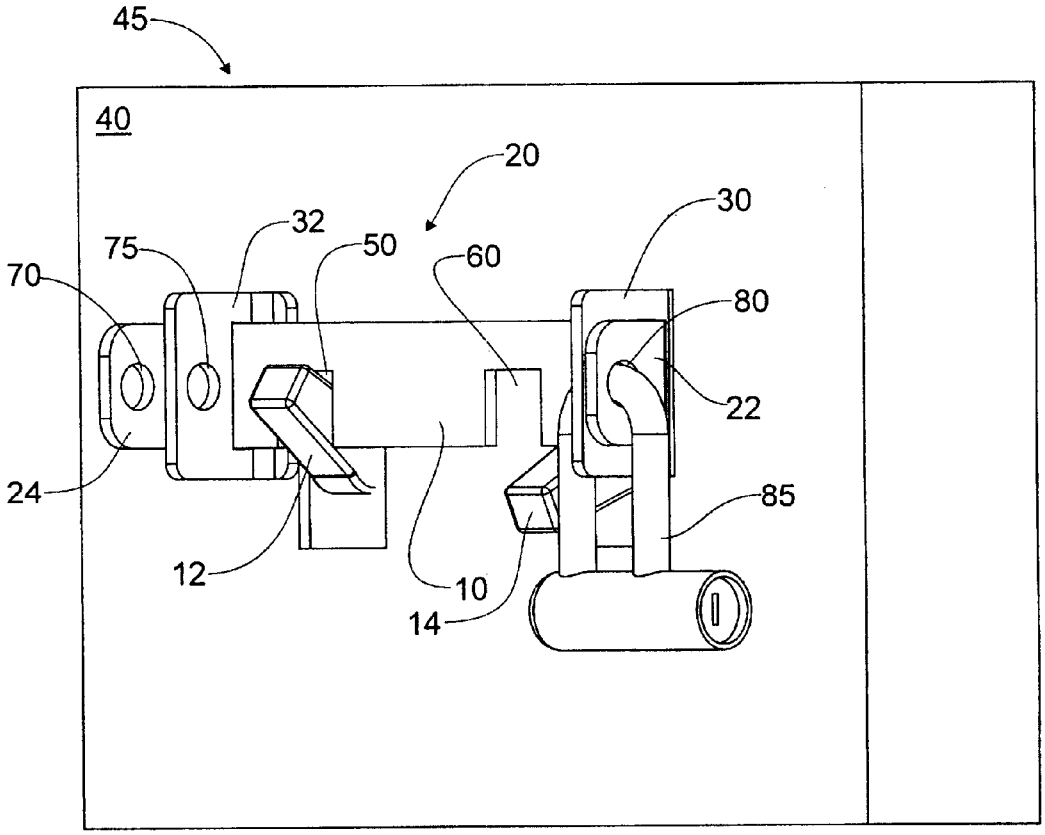
FIG. 5 is a perspective view of the interlocking device locked in a first position.

Referring now to FIG. 5, complementary first locking apertures are formed respectively, within bend 24 and the projecting flange of guide member 32. Similarly, complementary second locking apertures are formed within bend 22 and the projecting flange of guide member 30. Accordingly, when bar 10 is in a first position, as shown in FIG. 5, second locking apertures are aligned. A locking means 85, such as a lock with a suitable shackle, is used to secure bend 22 with guide member 30. The lock shackle is passed through aperture 80 formed in bend 32 and through complementary aperture (not shown) formed in guide member 30 and locked into place. As can be appreciated, this prevents locking bar 10 from being slid from the first position to the second position and the unauthorized placement of actuator 14 in a closed operating position. Similarly, locking means 85 can be used likewise to secure locking bar 10 in a locked second position via first complementary locking apertures 70, 75. As can be further appreciated, this prevents locking bar 10 from being slid from the second position to the first position and the unauthorized placement of actuator 12 in a closed operating position.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An interlocking device that prevents simultaneous throwing of at least two switch actuators, comprising:

a support surface;

a pair of switch actuators mounted on said support surface in lateral relation to one another;

each switch actuator of said pair of switch actuators having a down position and an up position;

an elongate locking bar having two laterally spaced apart switch actuator-receiving recesses formed therein;

said elongate locking bar being slideably mounted relative to said support surface for lateral displacement in closely spaced relation to said pair of switch actuators;

said elongate locking bar having a first position where a first switch actuator receiving recess is in alignment with a first switch actuator so that said first switch actuator can be thrown;

a second switch actuator recess being misaligned with a second switch actuator when said first switch actuator recess is in said alignment with said first switch actuator;

said elongate locking bar having a second position where said second switch actuator receiving recess is in alignment with said second switch actuator so that said second switch actuator can be thrown;

said first switch actuator recess being misaligned with said first switch actuator when said second switch actuator recess is in said alignment with said second switch actuator;

whereby said elongate locking bar prevents simultaneous throwing of said pair of switches.

2. The apparatus of claim 1, further comprising a pair of laterally spaced apart guide members mounted to said support surface, said guide members collectively slideably receiving said elongate support bar so that said elongate locking bar is guided by said guide members as said elongate locking bar is slid between said first and second positions.

3. The apparatus of claim 1, further comprising a pair of laterally spaced apart detent means for limiting lateral travel of said locking bar so that said elongate locking bar abuts a first detent means when said first switch actuator recess is in registration with said first switch actuator and so that said elongate locking bar abuts a second detent means when said second switch actuator recess is in registration with said second switch actuator.

4. The apparatus of claim 3, wherein said pair of detent means includes a bend formed in opposite ends of said elongate locking bar, a first bend abuttingly engaging said first guide means when said locking bar is in said first position and a second bend abuttingly engaging said second guide means when said locking bar is in said second position.

5. The apparatus of claim 1, further comprising a locking means wherein said locking means secures said locking bar in a first position when said locking bar is in said first position, said locking means secures said locking bar in a second position when said locking bar is in said second position.

6. An interlocking device that prevents simultaneous throwing of at least two switch actuators, comprising:

a support surface;

a pair of switch actuators mounted on said support surface in lateral relation to one another;

each switch actuator of said pair of switch actuators having a down position and an up position;

an elongate locking bar having two laterally spaced apart switch actuator-receiving recesses formed therein;

said elongate locking bar being slideably mounted relative to said support surface for lateral displacement in closely spaced relation to said pair of switch actuators;

said elongate locking bar having a first position where a first switch actuator receiving recess is in alignment with a first switch actuator so that said first switch actuator can be thrown;

a second switch actuator recess being misaligned with a second switch actuator when said first switch actuator recess is in said alignment with said first switch actuator;

said elongate locking bar having a second position where said second switch actuator receiving recess is in alignment with said second switch actuator so that said second switch actuator can be thrown;

said first switch actuator recess being misaligned with said first switch actuator when said second switch actuator recess is in said alignment with said second switch actuator;

a pair of laterally spaced apart guide members mounted to said support surface, said guide members collectively slideably receiving said elongate support bar so that said elongate locking bar is guided by said guide members as said elongate locking bar is slid between said first and second positions;

a pair of laterally spaced apart detent means for limiting lateral travel of said locking bar so that said elongate locking bar abuts a first detent means when said first switch actuator recess is in registration with said first switch actuator and so that said elongate locking bar abuts a second detent means when said second switch actuator recess is in registration with said second switch actuator, wherein said pair of detent means includes a bend formed in opposite ends of said elongate locking bar, a first bend abuttingly engaging said first guide means when said locking bar is in said first position and a second bend abuttingly engaging said second guide means when said locking bar is in said second position;

a locking means wherein said locking means secures said locking bar in a first position when said locking bar is in said first position, said locking means secures said locking bar in a second position when said locking bar is in said second position;

whereby said elongate locking bar prevents simultaneous throwing of said pair of switches.

* * * * *